US006629353B2

(12) United States Patent
Favre-Marinet et al.

(10) Patent No.: US 6,629,353 B2
(45) Date of Patent: Oct. 7, 2003

(54) DOME MADE OF ALUMINUM ALLOY; PARTICULARLY INTENDED TO FORM THE BOTTOM OF A TANK; AND METHOD OF MANUFACTURING IT

(75) Inventors: Georges Favre-Marinet, Verneuil-sur-Seine (FR); Jean-Pierre Bonnafe, Fontenay le Fleury (FR); Jacques Chanteranne, Le Pecq (FR); Joël Delmotte, Rueil Malmaison (FR)

(73) Assignee: Eads Launch Vehicles, Paris (FR)

( * ) Notice: Subject to any disclaimer, the term of this patent is extended or adjusted under 35 U.S.C. 154(b) by 0 days.

(21) Appl. No.: 10/030,253

(22) PCT Filed: May 21, 2000

(86) PCT No.: PCT/FR01/01556

§ 371 (c)(1),
(2), (4) Date: Jan. 9, 2002

(87) PCT Pub. No.: WO01/89733

PCT Pub. Date: Nov. 29, 2001

(65) Prior Publication Data

US 2003/0006270 A1 Jan. 9, 2003

(30) Foreign Application Priority Data

May 22, 2000 (FR) ..... 00 06503

(51) Int. Cl.[7] ..... B21D 35/00; B23P 21/00; B23K 31/02; B23K 1/19

(52) U.S. Cl. ..... 29/469.5; 29/469; 228/173.1; 228/262.5; 220/4.12

(58) Field of Search ..... 228/173.1, 184, 228/262.5, 262.51; 29/469, 469.5, 505–511; 220/62.17, 516, 517, 555, 4.12; 72/60–63

(56) References Cited

U.S. PATENT DOCUMENTS

| | | | | |
|---|---|---|---|---|
| 3,572,073 A | | 3/1971 | Dean et al. | |
| 3,739,617 A | | 6/1973 | Stejskal | |
| 4,024,623 A | * | 5/1977 | Kun | 76/107.1 |
| 4,181,235 A | * | 1/1980 | Baysinger | 220/4.12 |
| 4,252,244 A | | 2/1981 | Christian et al. | |
| 4,536,243 A | * | 8/1985 | Imatani et al. | 156/274.6 |
| 5,152,452 A | | 10/1992 | Fendel | |
| 5,295,804 A | * | 3/1994 | Dinnan | 425/182 |
| 5,665,439 A | * | 9/1997 | Andersen et al. | 428/34.5 |
| 5,697,511 A | * | 12/1997 | Bampton | 220/4.12 |
| 5,794,341 A | * | 8/1998 | Carlini | 29/898.061 |
| 6,301,767 B1 | * | 10/2001 | Granger et al. | 29/469.5 |
| 6,343,496 B1 | * | 2/2002 | Hanna et al. | 72/61 |
| 6,364,197 B1 | * | 4/2002 | Oelgoetz et al. | 228/112.1 |

FOREIGN PATENT DOCUMENTS

| | | |
|---|---|---|
| FR | 1159269 | 6/1958 |
| FR | 2326997 | 5/1977 |

* cited by examiner

*Primary Examiner*—M. Alexandra Elve
*Assistant Examiner*—Lynne Edmondson
(74) *Attorney, Agent, or Firm*—Stevens, Davis, Miller & Mosher, LLP

(57) ABSTRACT

The invention concerns a dome (34) consisting of a round-shaped vessel (30) provided with an opening (28) at the top and by a cap (33) welded on said basin to close said opening (28). The basin is obtained by hot forming under pressure of a truncated blank (5) made of non tempered aluminum alloy.

8 Claims, 7 Drawing Sheets

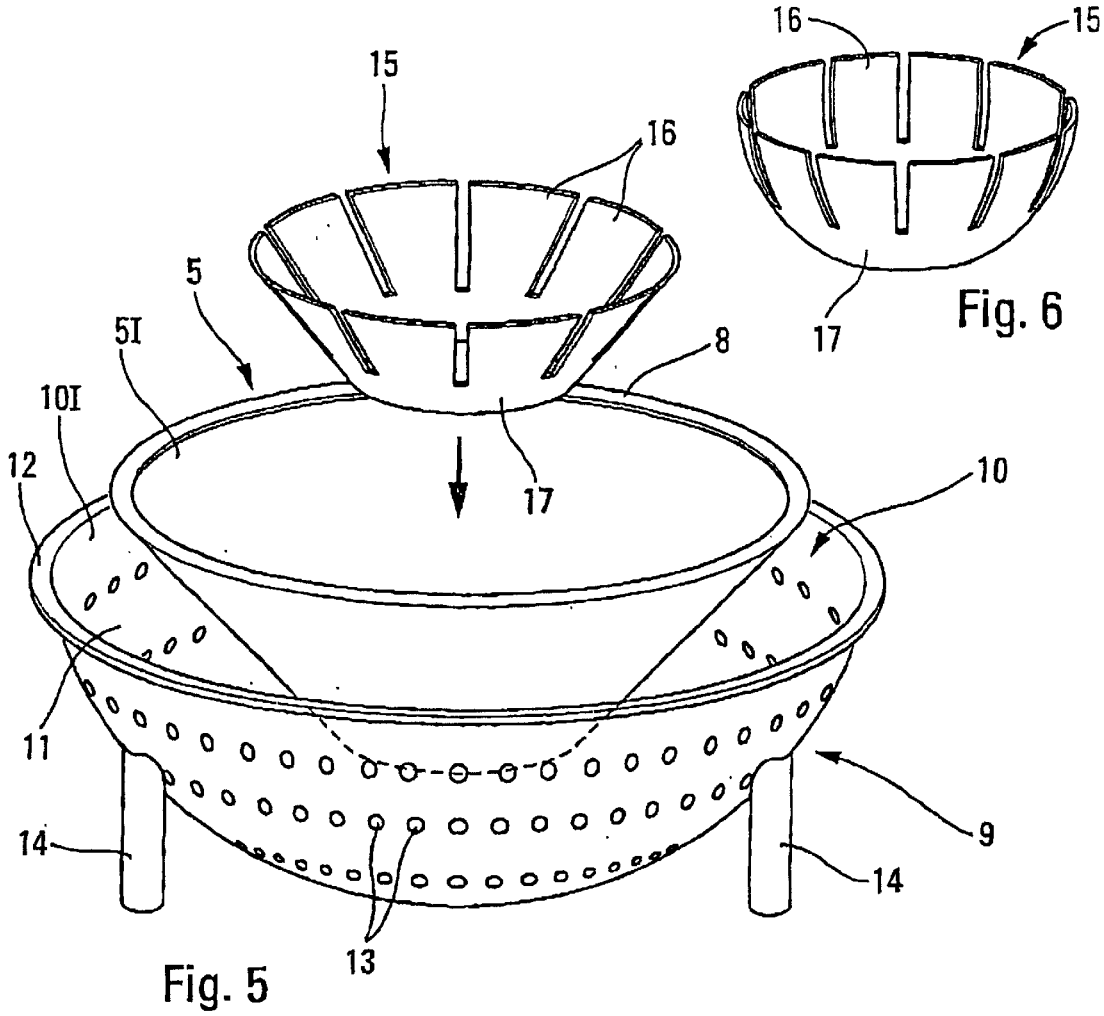
Fig. 6
Fig. 5
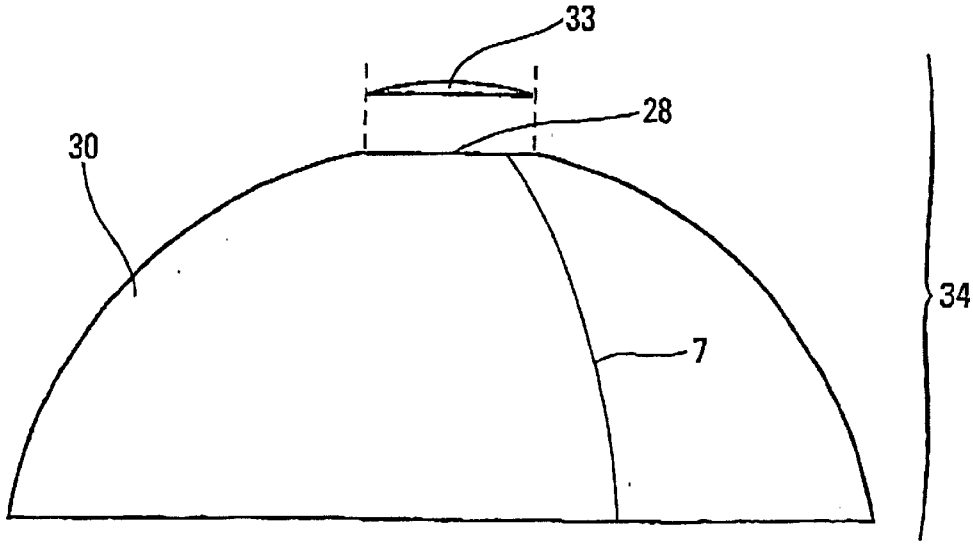
Fig. 16

DOME MADE OF ALUMINUM ALLOY; PARTICULARLY INTENDED TO FORM THE BOTTOM OF A TANK; AND METHOD OF MANUFACTURING IT

The present invention relates to a dome made of aluminum alloy, particularly intended to form the bottom of a tank, and to the method of manufacturing it.

It is known that rockets and space shuttles comprise large-sized tanks for storing the fuels intended to propel them. The bottoms of such tanks are made of aluminum alloy and have the shape of a dome several meters in diameter.

To manufacture a tank bottom such as this, it is commonplace for a number of curved sectors, for example eight curved sectors, to be produced individually, these then being secured together via radial weld lines to form said tank bottom.

Such a method of manufacture is lengthy and expensive, particularly because of the high number of constituent parts and the long lengths of the numerous weld lines. Hence, the main object of the present invention is to reduce the cost of manufacture of such tank bottoms.

To this end, according to the invention, the dome made of a weldable aluminum alloy, particularly intended to form the bottom of a tank, is noteworthy in that it consists of a dish of rounded shape with an opening at its top, and of a cap welded onto said dish to seal off its opening.

Thus, the dome according to the present invention is formed with just two parts—the dish and the cap along—a single weld line of relatively limited length. This then results in a significant reduction in the cost of manufacture by comparison with the usual method recalled herein above.

Of course, said cap may easily be manufactured by any known forming operation. As regards the manufacture of the dish, the applicant company has developed a particularly advantageous method.

Specifically, according to the invention, the method for producing a dish of rounded shape, open at its top, of a weldable aluminum alloy, particularly for producing the bottom of a tank, is notable in that:

a) a mold is produced, the interior face of the cavity of which corresponds to the shape of said dish, said mold being closed at its top and open at the opposite end from said top;

b) a blank in the shape of a cone frustum is produced, by bending and welding, from at least one flat piece in the shape of a portion of an annulus of such an untempered aluminum alloy;

c) said frustoconical blank is completely inserted in said mold, so that it adopts an initial position in which it is concentric with said mold, with:
   - its exterior frustoconical face facing said interior face of said cavity;
   - its small base resting on said interior face of the cavity near the top of said mold; and
   - its large base close to said interior face of the cavity near the opening of said mold;

d) a deformable pressing wall is arranged peripherally inside said frustoconical blank, against its interior face and near its small base;

e) said frustoconical blank and said deformable pressing wall are subjected to a first phase of a heat treatment with pressure, during which phase said frustoconical blank and said deformable pressing wall in contact therewith bend toward the interior face of said cavity at the same time progressing toward the top of said mold, being swallowed by the latter;

f) the progression of said frustoconical blank and of said deformable pressing wall toward the top of said mold is halted when said blank and said pressing wall reach a predetermined position of swallowing;

g) in this predetermined position of swallowing, said heat treatment with pressure is continued by a second phase, during which phase the exterior face of said blank is molded to the interior face of said cavity, with said pressing wall pressed against the interior face of said blank;

h) at the end of said heat treatment with pressure, said blank shaped into a rounded dish, open at the top, is extracted from the mold.

The applicant company has found that:

due to the progressive swallowing of the frustoconical blank by the mold, under the action of heat and pressure, it is possible to limit to an acceptable level the mechanical stresses experienced by said blank for making it change from the frustoconical shape to the shape of a rounded dish, for example a spherical dish;

halting the swallowing of said frustoconical blank at a predetermined value avoids an undesirable build-up of material of the frustoconical blank near the top of the mold; and the action of the pressing wall near the small base of the blank, in collaboration with the halting of the swallowing, makes it possible for said dish to be given a perfect shape near its opening, avoiding buckling of said dish at this point.

Of course, it is possible to contrive for said dish to have a thickness which is constant at all points or on the contrary, to have a greater thickness in some of its regions, by adjusting accordingly the distribution of thickness of said flat piece or pieces in the shape of (a) portion(s) of an annulus, from which the frustoconical blank is made.

In an advantageous embodiment of the method according to the invention, after said second phase, said heat treatment with pressure is continued by a third phase of tempering, allowing said dish open at its top to be structurally hardened.

Said anti-buckling deformable pressing wall may be formed of a set of deformable leaves, preferably curved, distributed around the periphery of the interior face of said frustoconical blank. It is then advantageous for said deformable leaves to be secured to one another at their ends near said small base of the frustoconical blank, for example by means of a peripheral strip.

The deformation pressure to which said frustoconical blank and said pressing wall are subjected during the heat treatment is preferably exerted by a pressing bladder introduced into said frustoconical blank. The wall of said mold is then advantageously pierced with through holes through which a vacuum can be pulled between said bladder and the interior face of the mold cavity so as to press said bladder against said frustoconical blank and said pressing wall so as to deform these until they are pressed firmly against the interior face of said mold cavity.

In order to allow controlled swallowing of said frustoconical blank and of said pressing wall by the mold during the first phase of said heat treatment, and for these to be halted in said predetermined position of swallowing, a sliding connection with end-of-travel stop is preferably provided between the edge of the opening of the mold and the large base of said frustoconical blank. For this purpose, the large base of the frustoconical blank may bear an interior protruding rim which forms part of said end-of-travel.

The figures of the appended drawing will make it easy to understand how the invention may be achieved. In these figures, identical references denote similar elements.

FIGS. 1 and 2 show, in a flat state, examples of flat pieces in the form of portions of an annulus, from which the dome according to the present invention can be formed.

FIG. 3 schematically illustrates the bending of the pieces of FIGS. 1 and 2.

FIG. 5 shows, in schematic perspective, a mold for implementing the invention, upon the introduction of the frustoconical blank and of the deformable pressing wall.

FIG. 6 shows an alternative form of the embodiment of said deformable pressing wall.

Figure 7:
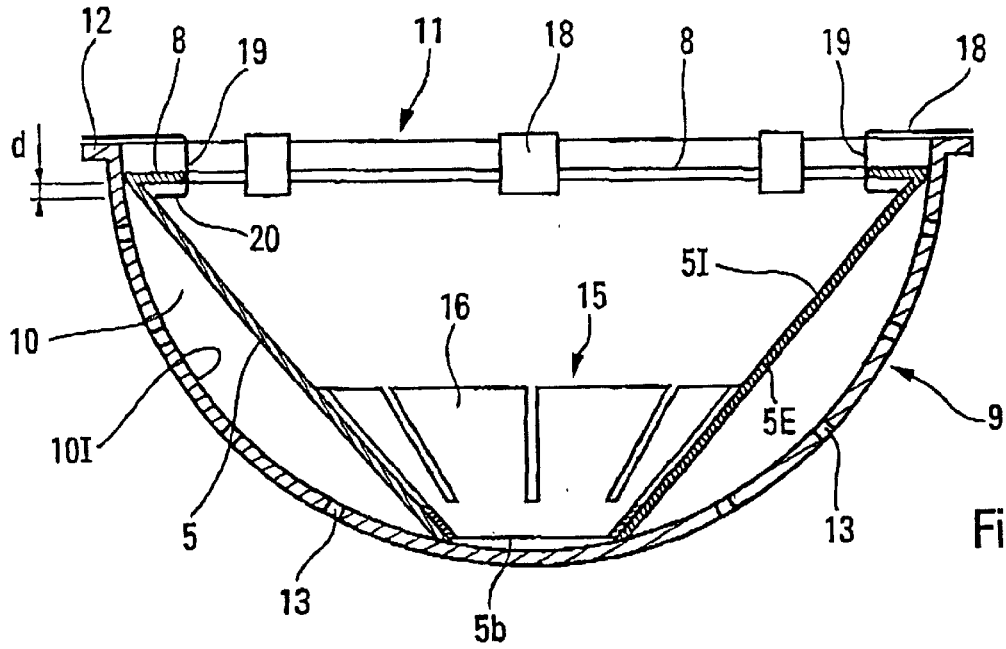
FIG. 7 illustrates in schematic section, said frustoconical blank in its initial position in the mold.
Figure 8:
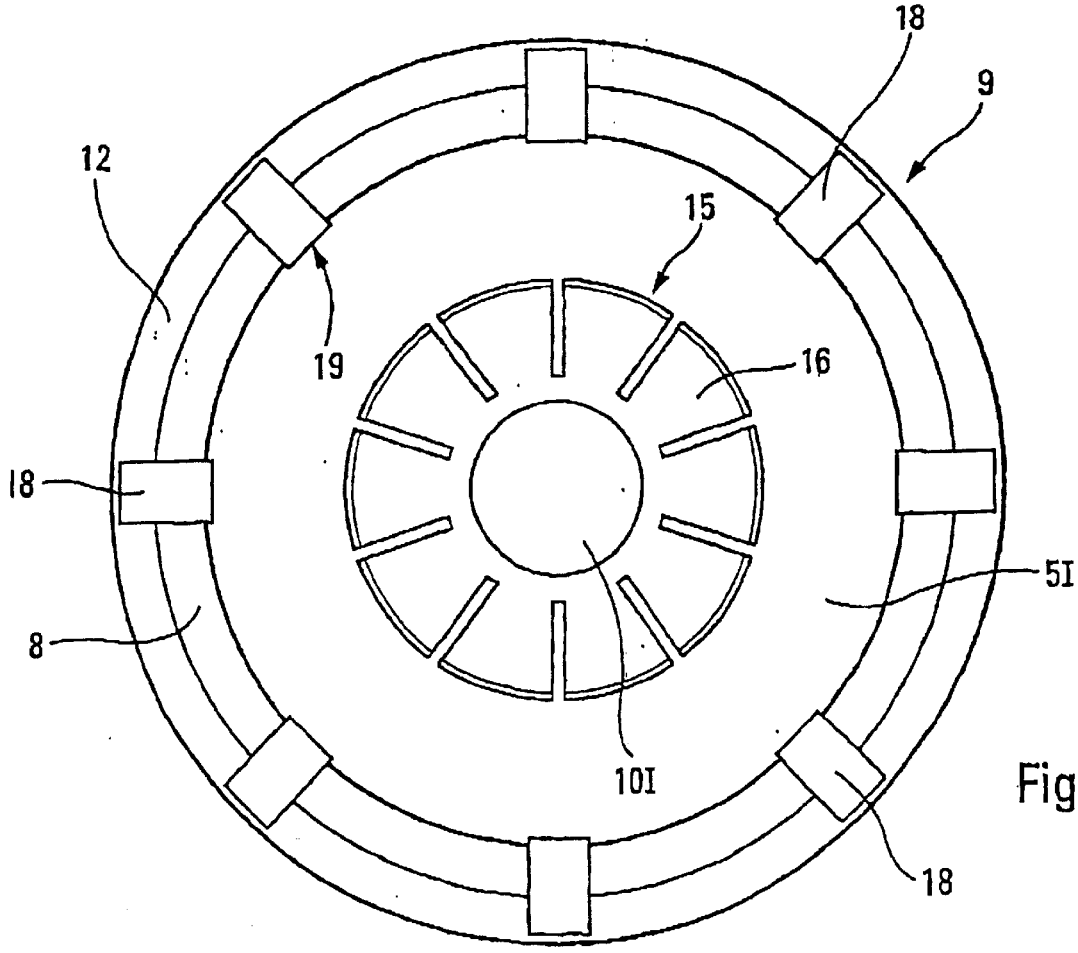
FIG. 8 is a view from above corresponding to FIG. 7.
Figure 9:
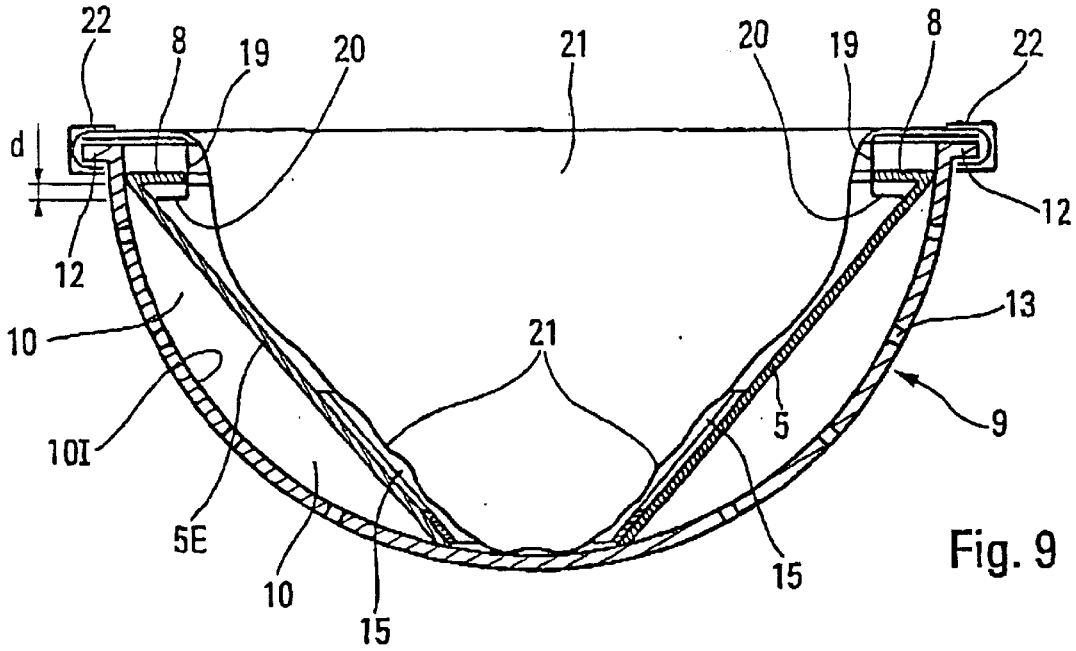
Figure 10:
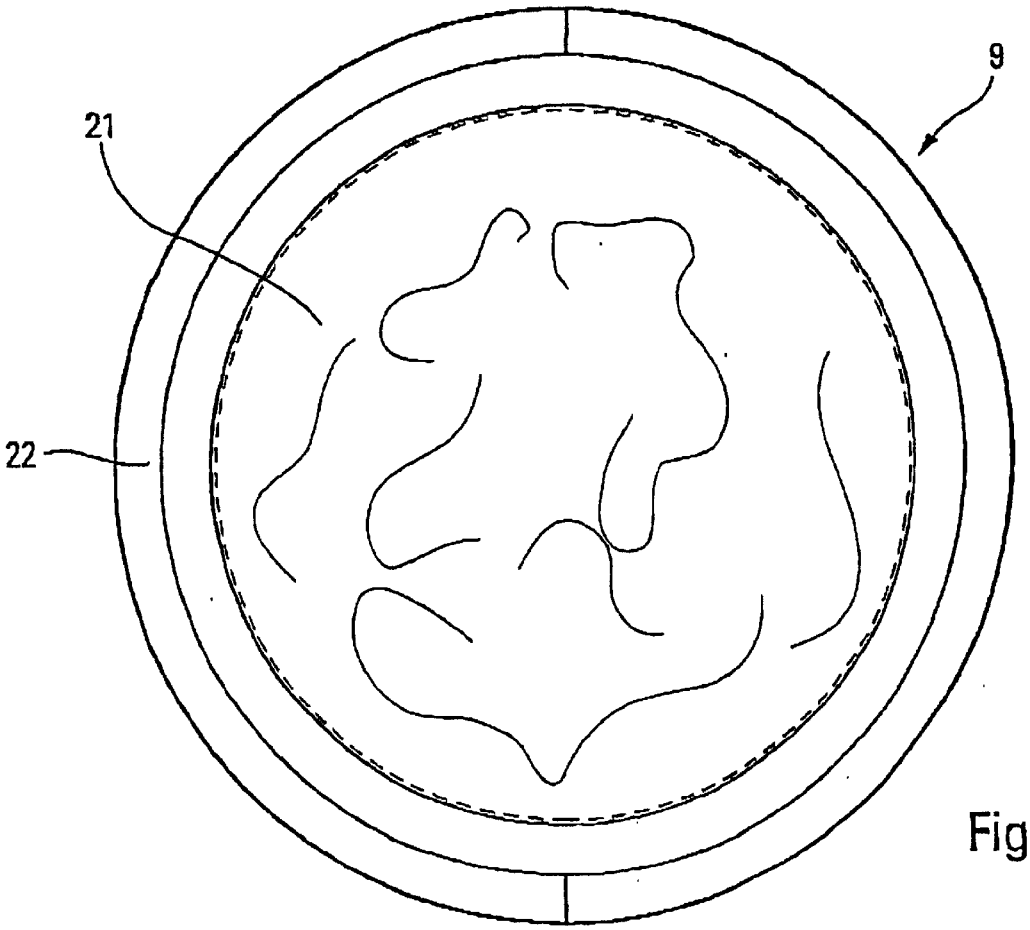

FIGS. 9 and 10 correspond respectively to FIGS. 7 and 8, after a pressing bladder has been installed.

Figure 11:
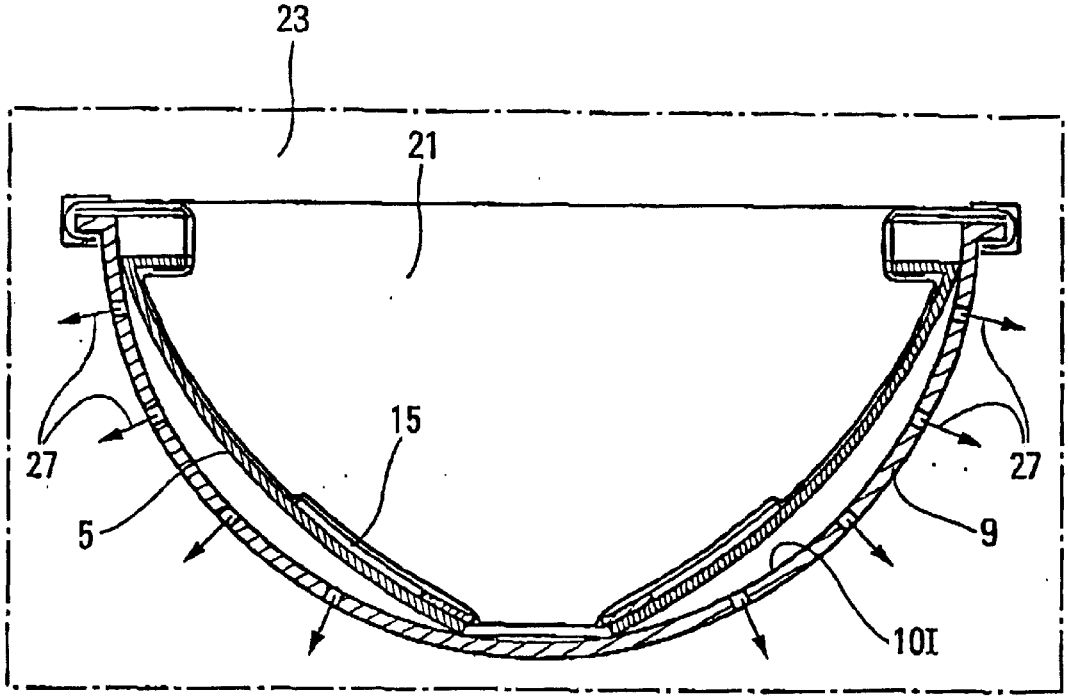

FIG. 11 illustrates, in schematic section, the mold with said frustoconical blank in its halted predetermined position of swallowing.

Figure 12:
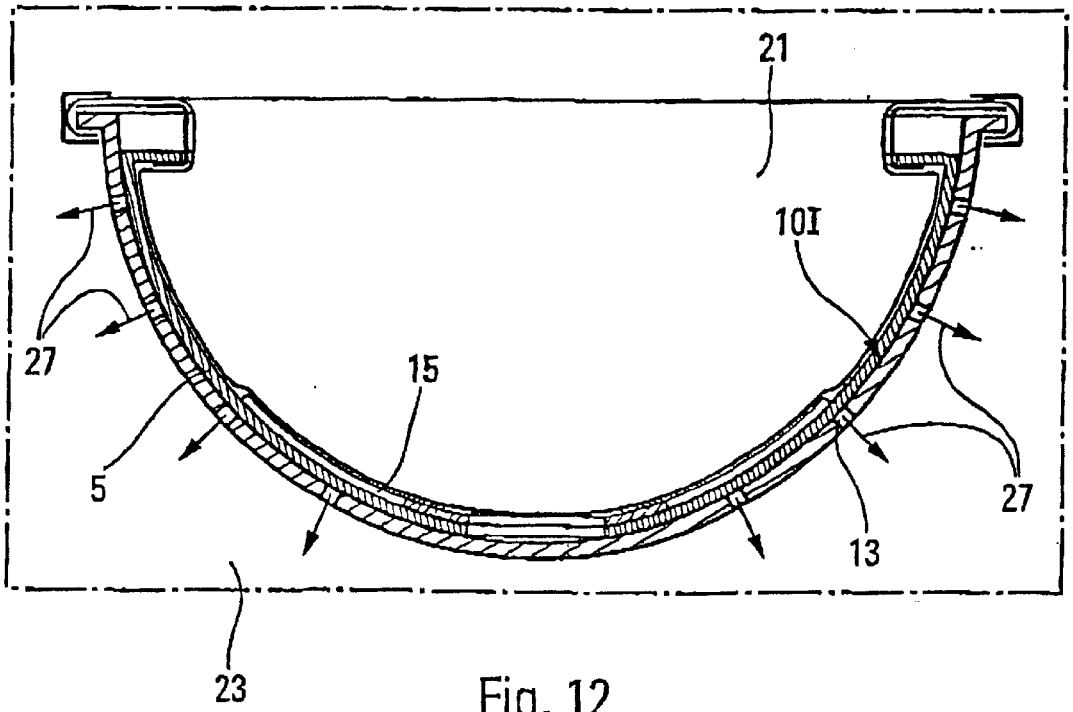

FIG. 12 illustrates, also in schematic section, said blank in its final position in the mold.

Figure 13:
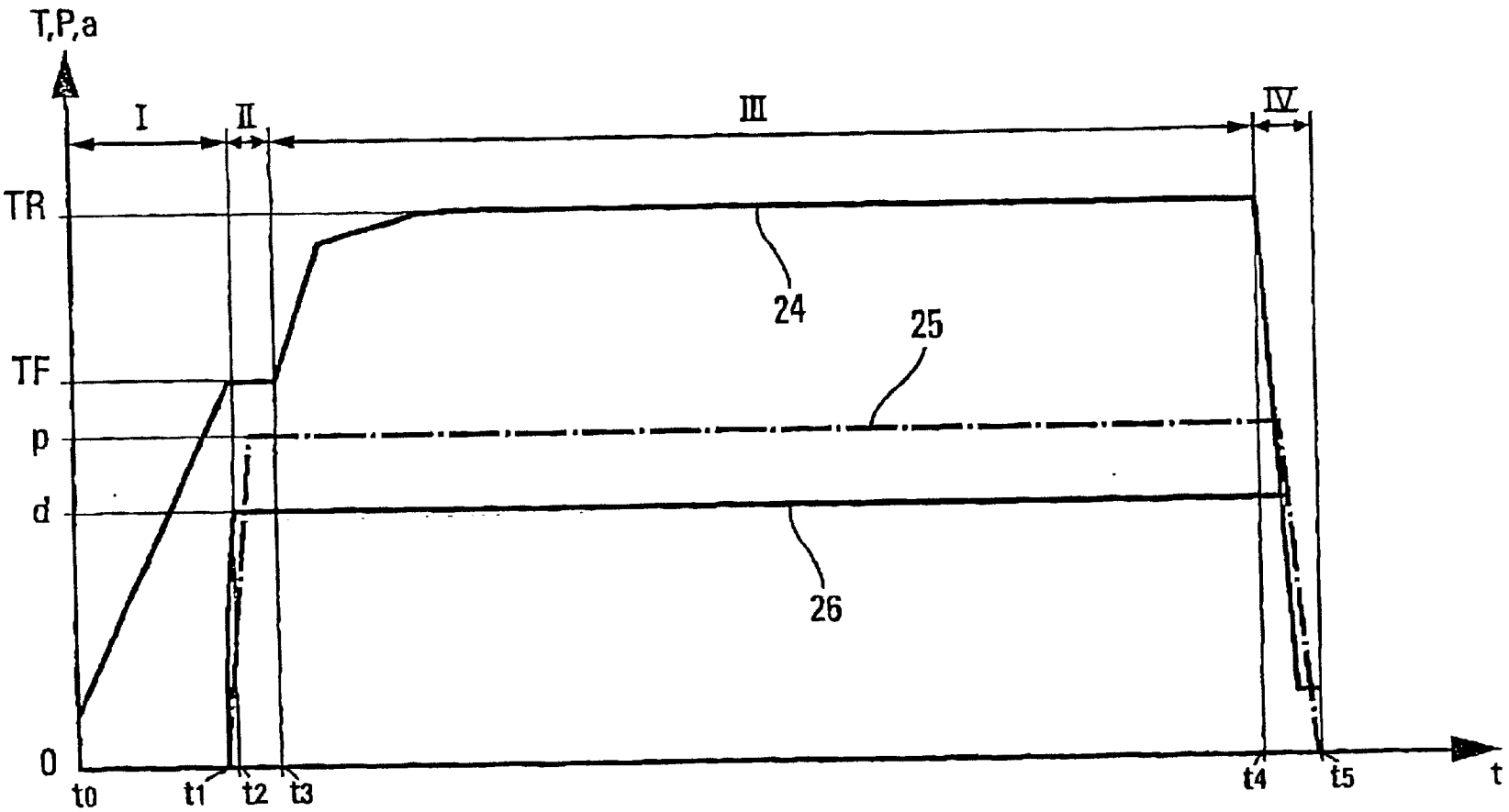

FIG. 13 is a diagram illustrating the heat treatment with pressure exerted on said frustoconical blank in said mold.

Figure 14:
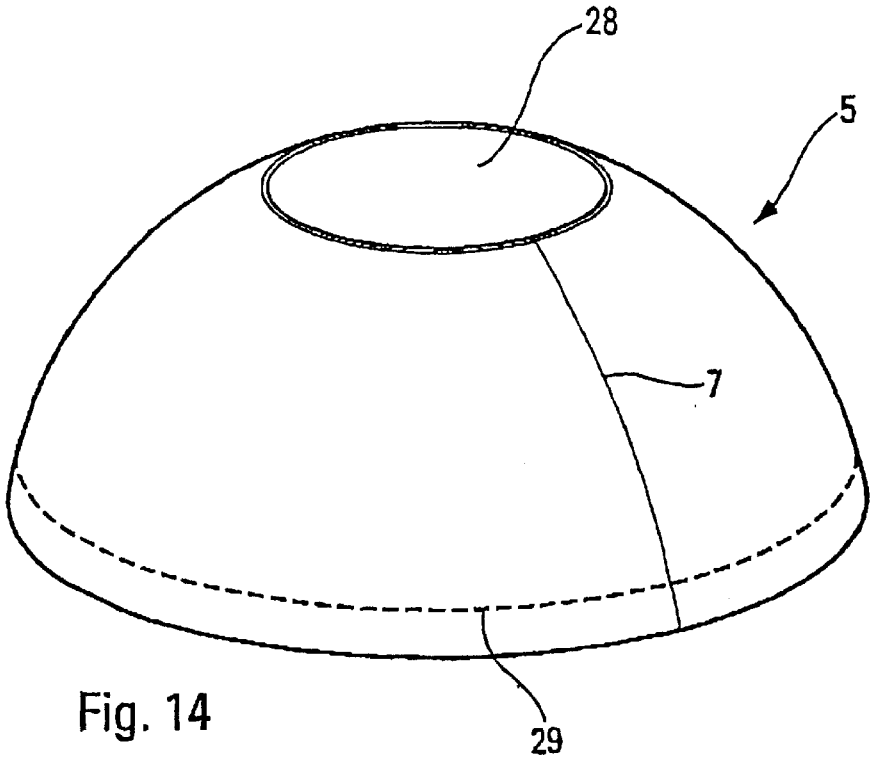

FIG. 14 illustrates the rounded dish as it leaves the mold.

Figure 15:
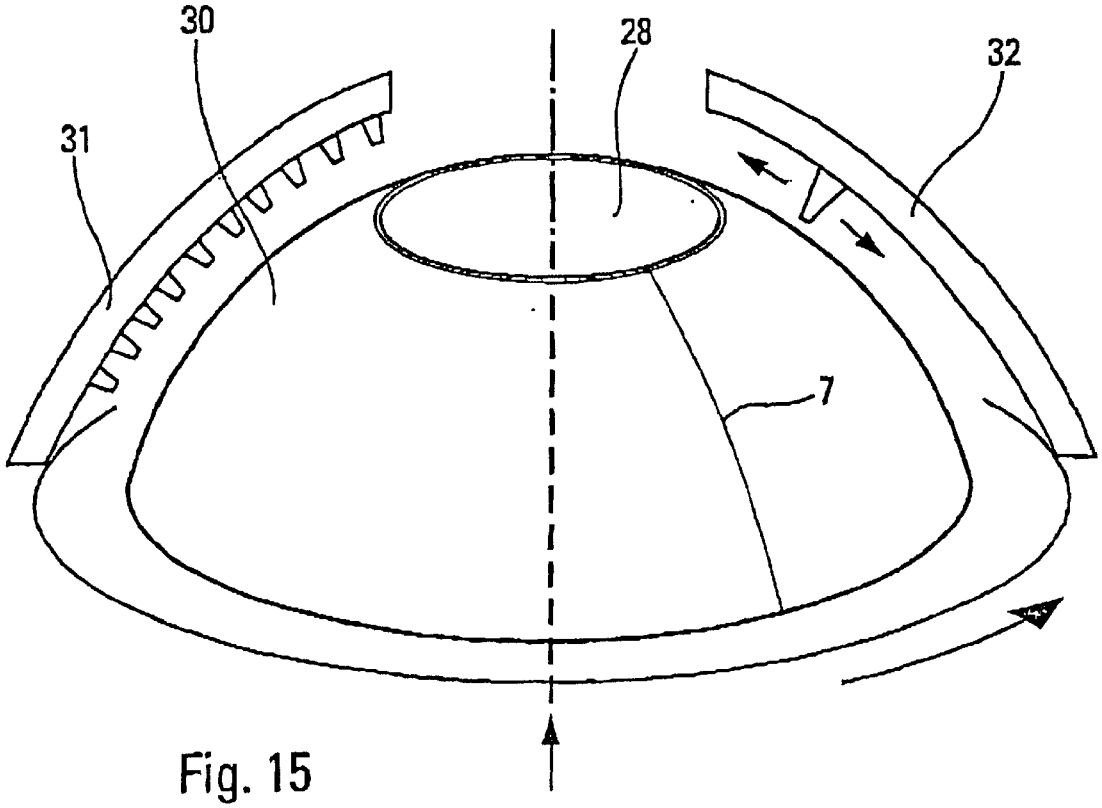

FIG. 15 illustrates testing performed on said dish.

FIG. 16 depicts, in exploded schematic elevation, the dome according to the present invention.

Figure 1:
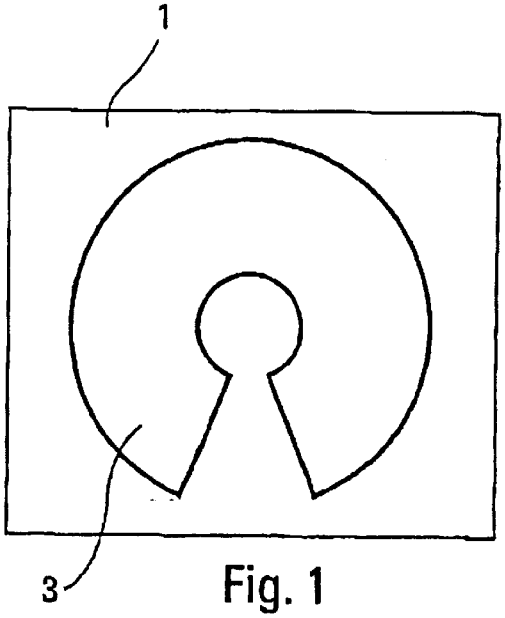
Figure 2:
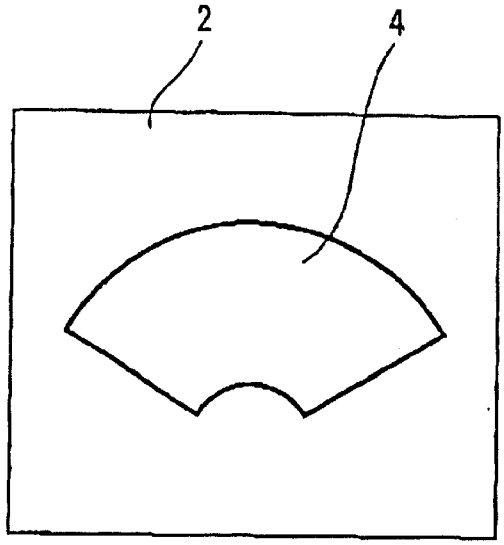

FIGS. 1 and 2 depict aluminum alloy sheets 1 and 2, from which flat pieces in the shape of portions of an annulus, 3 and 4 respectively, are cut. The sheets 1 and 2 are made for example of the known alloys 2219 or 2195, in the untempered state (T37).

Figure 3:
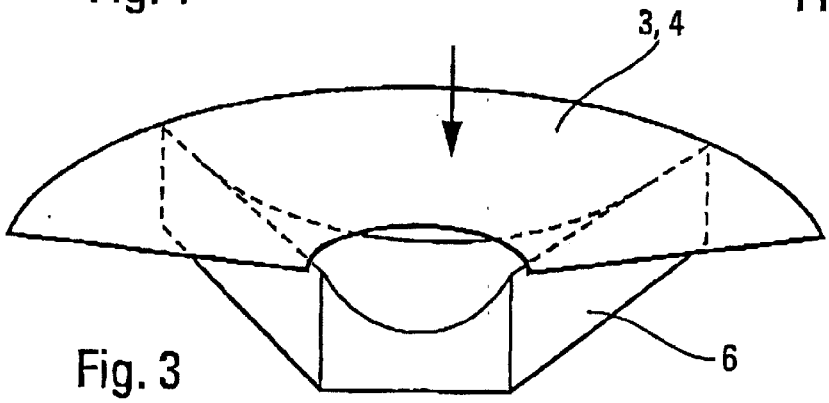
Figure 4:
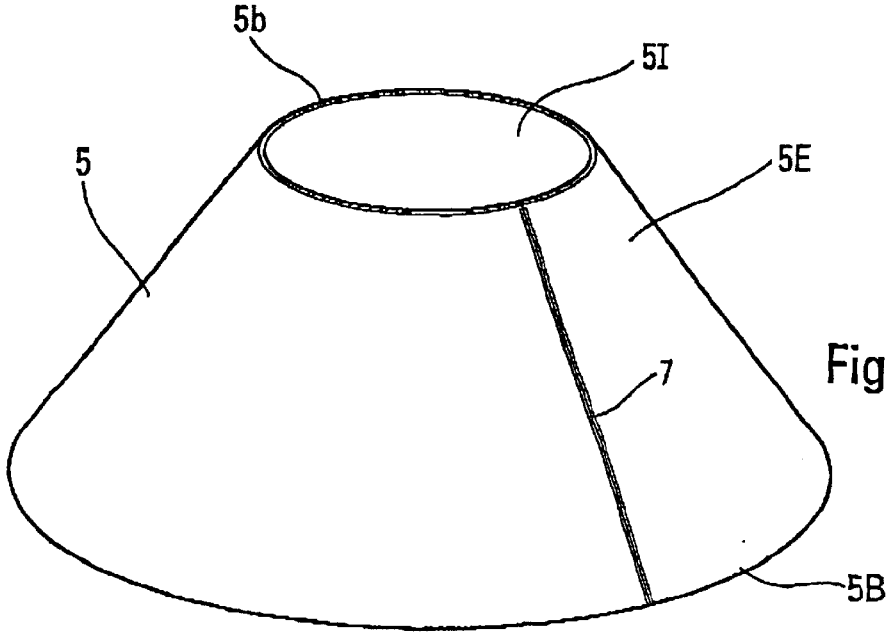
FIG. 4 shows, in perspective, a frustoconical blank obtained from the pieces of FIGS. 1 and 2.

A blank 5 in the shape of a cone frustum (see FIG. 4) is made from one piece 3 or two pieces 4, by bending over a form 6 (see FIG. 3) and welding along facing generatrices. FIG. 4 depicts a weld line 7 closing the frustoconical blank 5.

After these operations, a re-entrant rim 8 is attached to the frustoconical blank 5, for example by welding, to the interior periphery of its large base 5B (see FIG. 5).

Furthermore, as shown in FIG. 5, a mold 9 is produced which delimits a cavity 10, the interior face 10I of which has the shape of a rounded dish, for example a spherical dish The mold 9 is closed at its top and, on the opposite side to this, is provided with an opening 11, bordered by an outwardly projecting peripheral rim 12. The wall of the mold 9 is pierced with a number of through openings 13. In addition, the mold 9 stands on feet 14, depicted only in FIG. 5.

A deformable pressing wall 15, for example of conical shape (FIG. 5) or coracle shape (FIG. 6), consisting of leaves 16 joined together by a common base 17 is also made. The pressing wall is made, for example, of an aluminum alloy similar to that of which the blank 5 is made and is shaped so that it can sit inside the frustoconical blank 5 in contact with the interior face 5I thereof, near the small base 5*b* of said blank and right around said interior face 5I.

As illustrated by FIGS. 5 and 7, the frustoconical blank 5 is completely introduced into the cavity 10 of the mold 9 through the opening 11 so that it adopts an initial position (shown by FIGS. 7 and 8) in which it is concentric with said mold. In this initial position:

the exterior frustoconical face 5E of said blank 5 faces the interior face 10I of the cavity 10 of the mold 9;

the small base 5*b* of the blank 5 rests on the interior face 10I of the cavity 10 near the top of the mold 9; and the large base 5B of the blank 5, and therefore the rim 8 it bears, are close to the interior face 10I of the cavity 10, near the opening 11 of the mold 9.

In addition, in this initial position, the deformable pressing wall 15 is arranged inside the frustoconical blank 5 against the interior face 5I thereof, near the small base 5*b* of said blank.

Moreover, distributed around the rim 12 of the opening 11 of the mold 9 are tabs 18 which are secured in any known way, not depicted, to said rim 12. Each tab 18 comprises an arm 19 which descends inside the rim 8 of the blank 5 and is equipped at its end with a hook 20 arranged under the said rim 8. In said initial position, each hook 20 is a distance d below the rim 8 of the blank 5.

In this initial position, and as illustrated by FIGS. 9 and 10, a pressing bladder 21 is arranged inside the frustoconical blank 5 and is fixed in a sealed manner, by virtue of fasteners 22, to the periphery of the entry 11 to the mold 9.

As shown by FIGS. 11 and 12, the mold 9 thus equipped with the frustoconical blank 5, with the pressing wall 15, with the tabs 18 and with the pressing bladder 21 is introduced into a heat chamber 23 equipped with means (not depicted) capable of pulling a vacuum, through the through orifices 13, in the space between the interior face 10I and the bladder 21.

FIG. 13 illustrates an example of heat treatment with pressure to which the frustoconical blank 5 and the pressing wall 15 are subjected. This FIG. 13 depicts, as a function of the time t, the variations in the temperature T in the heat chamber 23 (curve 24), in the pressure P exerted by the pressing bladder 21 (curve 25) and in the swallowing a of the blank 5 by the mold 9 (curve 26). This example of a heat treatment essentially comprises four successive phases I to IV.

The first phase I begins at an initial instant to, at which the mold 9, the frustoconical blank 5, the pressing wall 15 and the bladder 21 are in the relative positions shown by FIG. 9. At this moment, the swallowing a is zero. The temperature T of the chamber 23 (for example an autoclave) increases uniformly to a forming value TF (for example of the order of 120° C.), which is reached at the end of phase I (instant t2). At an instant t1 in phase I, prior to the instant t2, a vacuum is pulled between the interior face 10I of the cavity of the mold 9 and the bladder 21 through the through holes 13 (arrows 27), so that the pressure exerted by the latter bladder on the frustoconical blank 5 and on the pressing wall 15 increases progressively (curve 25). The result of this is that said blank 5 and said pressing wall 15 curve toward the interior face 10I of the cavity of the mold and are swallowed by the mold 9, the rim 8 gradually moving closer to the hook 20. At the instant t2, the rim 8 is resting against the hook 20 and the swallowing a has adopted the value d. This then corresponds to the relative positions illustrated in FIG. 11.

In phase II, beginning at the instant t2, the temperature T is held at the forming value TF and the pressure P is increased to a steady value p, the swallowing remaining constant and equal to the value d. At the instant t3, at which phase II ends, the forming of the blank 5 is completed and the corresponding state of the various elements is depicted in FIG. 12.

Next, the tempering phase III begins at the instant t3, during which phase the temperature T is raised and held at the tempering value TR, for example of the order of 170° C. The blank 5, now shaped into a rounded dish, is therefore structurally hardened.

Between the instants t4 and t5 and during a phase IV, the blank 5 is cooled.

Once the cooling phase IV is over, the blank 5, shaped into a rounded dish and provided with an opening 28 at its top, is removed from the mold 9 and cut along a line 29 around its large base, to remove the protruding interior rim 8 (see FIG. 14). This then yields the open dish 30 shown in FIG. 15.

The preciseness of the rounded shape of the dish 30 is checked using a set of geometric sensors 31, and non-destructive testing of the quality of the wall of this dish 30 is performed using a device 32 (X-ray and/or by eddy-current inspection).

A top cap 33 manufactured separately, using any known technique (for example drawing), is attached and welded to said dish 30 to seal off its opening 28. This then yields a dome 34 according to the present invention.

What is claimed is:

1. A method for producing a dish of rounded shape, open at its top, of a weldable aluminum alloy, particularly for producing the bottom of a tank, the method comprising:

(a) providing a mold having an interior face cavity that corresponds to the shape of said dish, said mold being closed at its top and open at an opposite end from said top;

(b) forming a blank in the shape of a cone frustum by bending and welding a flat piece of an untempered aluminum alloy having a shape of a portion of an annulus;

(c) inserting said blank completely into said mold, so that:

said blank has an initial position that is concentric with said mold, an exterior frustoconical face of said blank faces said interior face of said cavity, a small base of said blank rests on said interior face of said cavity near the top of said mold, and a large base of said blank is close to said interior face of said cavity near the opening of said mold;

(d) arranging a deformable pressing wall peripherally inside said blank, against an interior face of said blank and near the small base;

(e) applying heat and pressure to said blank and said deformable pressing wall during a first phase, to cause:

said blank and said deformable pressing wall in contact therewith to bend toward the interior face of said cavity, and said blank to progress toward the top of said mold and conform to the shape of said cavity's interior face;

(f) halting progression of said blank and said deformable pressing wall toward the top of said mold, when said blank and said deformable pressing wall reach a predetermined position of conformity with said cavity;

(g) applying said heat and pressure during a second phase to:

mold said exterior face of said blank to the shape of said interior face of said cavity, and press said deformable pressing wall against said interior face of said blank and thereby contribute to molding said exterior face of said blank;

(h) extracting said blank, which is formed into said rounded dish having an opening at the top, from the mold.

2. The method of claim 1, further comprising tempering, after completing step (g) and prior to performing step (h), said dish with said heat and pressure so that said dish is structurally hardened in said mold.

3. The method of claim 1, wherein:

said deformable pressing wall is formed of a set of deformable leaves; and said deformable leaves are distributed around the periphery of the interior face of said frustoconically shaped blank when said deformable pressing wall is arranged in said blank.

4. The method of claim 3, wherein said deformable leaves are secured to one another at their respective first ends, which first ends are closest to said small base of said blank when said deformable pressing wall is arranged in said blank.

5. The method of claim 1, further comprising:

inserting a bladder within an interior face of said deformable pressing wall and said interior face of said blank, wherein:

said bladder exerts the pressure to said deformable pressing wall and said blank during the first and second phases.

6. The method of claim 5, wherein said mold is pierced with through holes through which a vacuum can be pulled between said bladder and the interior face of said cavity so as to press said bladder against said blank and said deformable pressing wall.

7. The method of claim 1, wherein a sliding connection with an end-of-travel stop is provided between an edge of the opening of said mold and the large base of said blank to enable:

said blank and said deformable pressing wall to conform to said mold through progressive movement during said first phase, and said mold to be halted in said predetermined position.

8. The method of claim 7, wherein the large base of said frustoconically shaped blank bears an interior protruding rim which forms part of said end-of-travel stop.

* * * * *